US009861243B1

(12) United States Patent
Caldwell

(10) Patent No.: US 9,861,243 B1
(45) Date of Patent: Jan. 9, 2018

(54) FLEXIBLE LIGHT WEIGHT VACUUM CLEANER HEAD

(71) Applicant: Gregory Caldwell, Bedford, NH (US)

(72) Inventor: Gregory Caldwell, Bedford, NH (US)

( * ) Notice: Subject to any disclaimer, the term of this patent is extended or adjusted under 35 U.S.C. 154(b) by 0 days.

(21) Appl. No.: 15/307,861

(22) PCT Filed: Jun. 30, 2016

(86) PCT No.: PCT/US2016/040282

§ 371 (c)(1),
(2) Date: Oct. 31, 2016

(51) Int. Cl.
*A47L 9/02* (2006.01)
*A47L 9/24* (2006.01)
*A47L 9/06* (2006.01)

(52) U.S. Cl.
CPC ..... *A47L 9/02* (2013.01); *A47L 9/242* (2013.01); *A47L 9/0693* (2013.01)

(58) Field of Classification Search
CPC ..... A47L 9/02; A47L 9/242; A47L 9/0693
USPC ..... 15/415.1
See application file for complete search history.

(56) References Cited

U.S. PATENT DOCUMENTS 3,085,267 A 4/1963 Jacuzzi
3,273,187 A 9/1966 Williams
4,374,446 A 2/1983 Copperman
4,476,607 A 10/1984 Ross
4,638,527 A 1/1987 Fleischhauer
4,653,137 A 3/1987 Fleischhauer
5,718,016 A 2/1998 Sung
6,430,773 B1 8/2002 Buron et al.
7,036,184 B2 5/2006 Kim
7,353,564 B2 4/2008 Wertz
8,359,706 B2 1/2013 Watzke
8,402,603 B1 3/2013 Meek
8,533,907 B2 9/2013 Eccardt et al.
8,918,947 B2 12/2014 Schwartz
2002/0133903 A1 9/2002 Vanderlinden
2005/0081327 A1 4/2005 Lim et al.
2005/0086764 A1 4/2005 Lim et al.
2007/0163076 A1 7/2007 Grey
2012/0090639 A1 4/2012 Heldman et al.
2012/0222230 A1 9/2012 McNamara
2013/0036568 A1 2/2013 Tussy
2013/0255022 A1 10/2013 Hammon et al.
2013/0326843 A1 12/2013 Schwartz
2015/0320275 A1 11/2015 Borges et al.

FOREIGN PATENT DOCUMENTS

WO 84/03429 A1 9/1984

*Primary Examiner* — David Redding
(74) *Attorney, Agent, or Firm* — Jonathan B. Whitcomb; Sheehan Phinney Bass & Green PA

(57) ABSTRACT

A head (200) for a vacuum cleaning device includes a central airflow conduit (255), first and second flexible tubular appendage (211, 212), and a cross member (240). Each tubular appendage includes an internal channel (220) connected to a surface channel (222) via a plurality of ingress vents (221). A cross member (240) structurally connects the first and second flexible tubular appendages such that a cross-connecting airflow channel provides airflow from the first and second tubular appendages to the central airflow conduit. The first and second flexible appendage are attached at an apex (215) to form an A-shaped structure with the cross member.

16 Claims, 10 Drawing Sheets

FLEXIBLE LIGHT WEIGHT VACUUM CLEANER HEAD

FIELD OF THE INVENTION

The present invention relates to household devices, and more particularly, is related to a head for a vacuum cleaner.

BACKGROUND OF THE INVENTION

A vacuum cleaner is a device that uses an air pump, for example, a centrifugal fan, to create a partial vacuum to suck up particles, for example, dust and/or dirt, usually from a target surface, for example, floors, upholstery and/or draperies. The particles are separated from the air flow and collected in a particle collection facility for later disposal, for example, a vacuum bag. A typical vacuum cleaner includes a collecting portion at the intake portion of the air flow path, called the head. The head is typically connected to an air conduit, for example, a pipe or hose, that draws air from the head to the particle collection facility and out an exhaust vent.

Previously known vacuum heads have been configured for various purposes, for example, a floor head, a carpet beater, a drapery tool, or a brush tool. FIG. 1 shows a prior art vacuum head (or nozzle), including a nozzle tube 1, a head assembly 2, roller axles 3, rollers 4, nozzle tube clamps 5, and screws 6.

In general, the region where air flow of the vacuum cleaner can effectively draw particles is confined to a space between the head assembly 2 and the target surface immediately adjacent to the head assembly 2. It is generally desirable that the airflow characteristics of the head allow for collection of particles in a few passes over the target surface as possible. Consequently, the process of cleaning a surface generally involves passing the head over the entire target surface, and the number of passes with the head over the target surface depends on the area of the head with respect to the surface, and the effectiveness of the head for collecting particles. Ideally, the number of passes may be reduced by using a head having a larger area in contact with the target surface.

Unfortunately, a larger head size often results in several disadvantages, such as additional bulk and weight, leading to difficulty maneuvering the head around obstacles on the target surface, for example, chair legs or table legs. Furthermore, a larger vacuum head may diminish the suction power as it is distributed over the area of the head, resulting in reduced cleaning effectiveness. In addition, a larger vacuum cleaner head may be inconvenient to store. Therefore, there is a need in the industry to address one or more of the abovementioned disadvantages.

SUMMARY OF THE INVENTION

Embodiments of the present invention provide a flexible light weight vacuum cleaner head. Briefly described, the present invention is directed to a head for a vacuum cleaning device includes a central airflow conduit, first and second flexible tubular appendage, and a cross member. Each tubular appendage includes an internal channel connected to a surface channel via a plurality of ingress vents. A cross member structurally connects the first and second flexible tubular appendages such that a cross-connecting airflow channel provides airflow from the first and second tubular appendages to the central airflow conduit. The first and second flexible appendage are attached at an apex to form an A-shaped structure with the cross member.

Other systems, methods and features of the present invention will be or become apparent to one having ordinary skill in the art upon examining the following drawings and detailed description. It is intended that all such additional systems, methods, and features be included in this description, be within the scope of the present invention and protected by the accompanying claims.

BRIEF DESCRIPTION OF THE DRAWINGS

The accompanying drawings are included to provide a further understanding of the invention, and are incorporated in and constitute a part of this specification. The components in the drawings are not necessarily to scale, emphasis instead being placed upon clearly illustrating the principles of the present invention. The drawings illustrate embodiments of the invention and, together with the description, serve to explain the principles of the invention.

DETAILED DESCRIPTION

Figure 1:
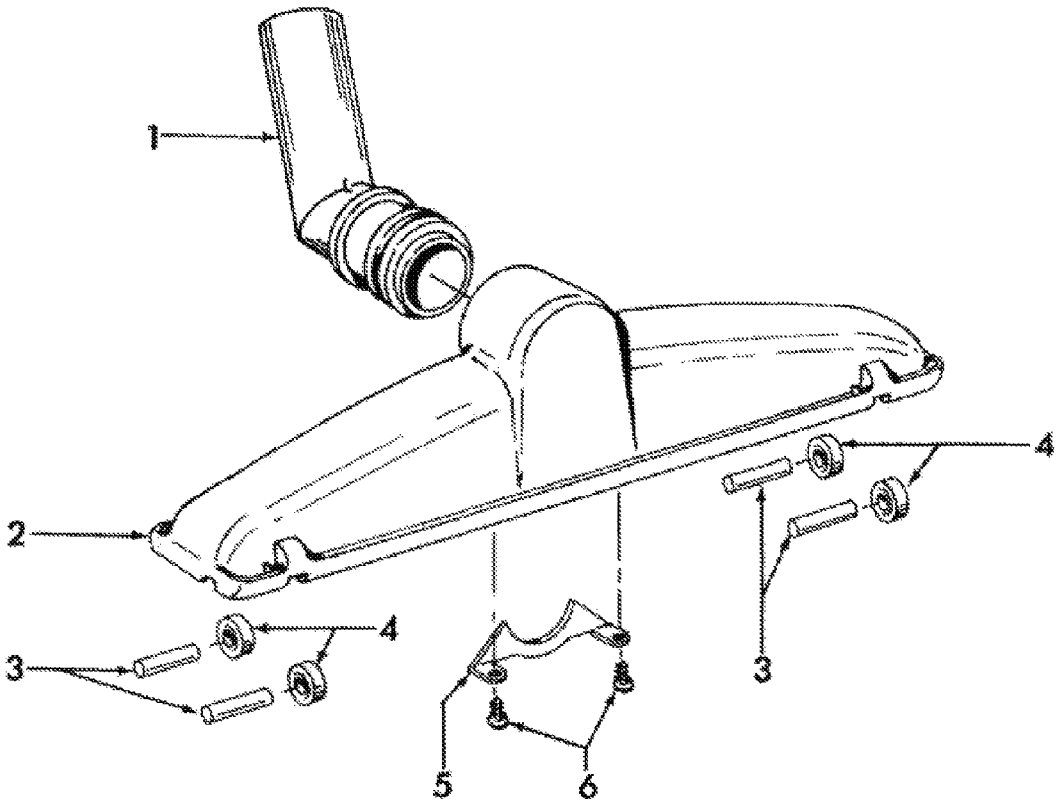
FIG. 1 (PRIOR ART)
FIG. 1 is a schematic diagram of a prior art vacuum head.

The following definitions are useful for interpreting terms applied to features of the embodiments disclosed herein, and are meant only to define elements within the disclosure.

Reference will now be made in detail to embodiments of the present invention, examples of which are illustrated in the accompanying drawings. Wherever possible, the same reference numbers are used in the drawings and the description to refer to the same or like parts.

Figure 2A:
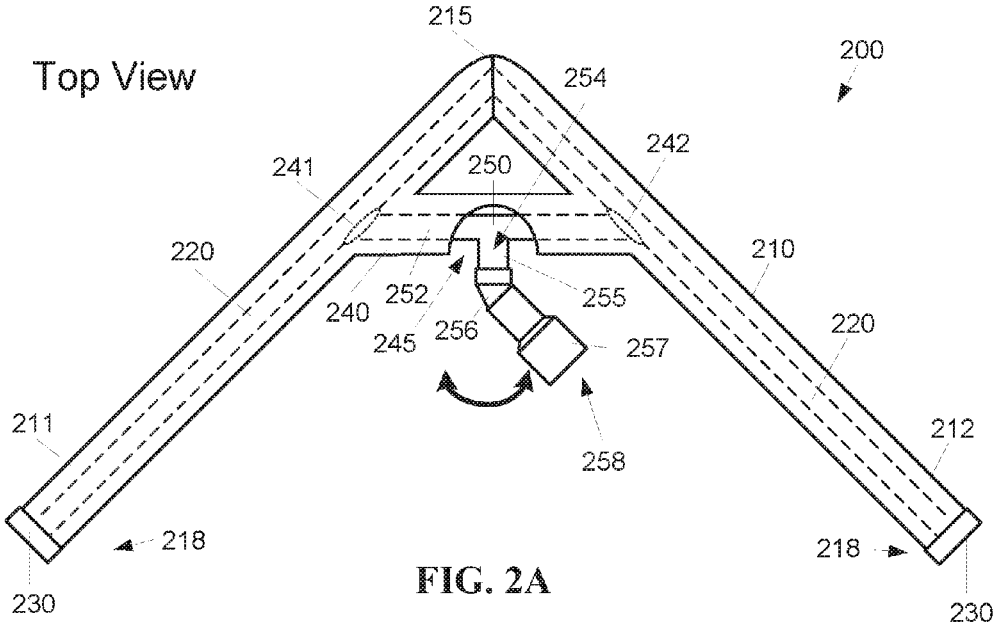
FIG. 2A is a schematic diagram of an exemplary first embodiment of a vacuum head from a top view.
Figure 2B:
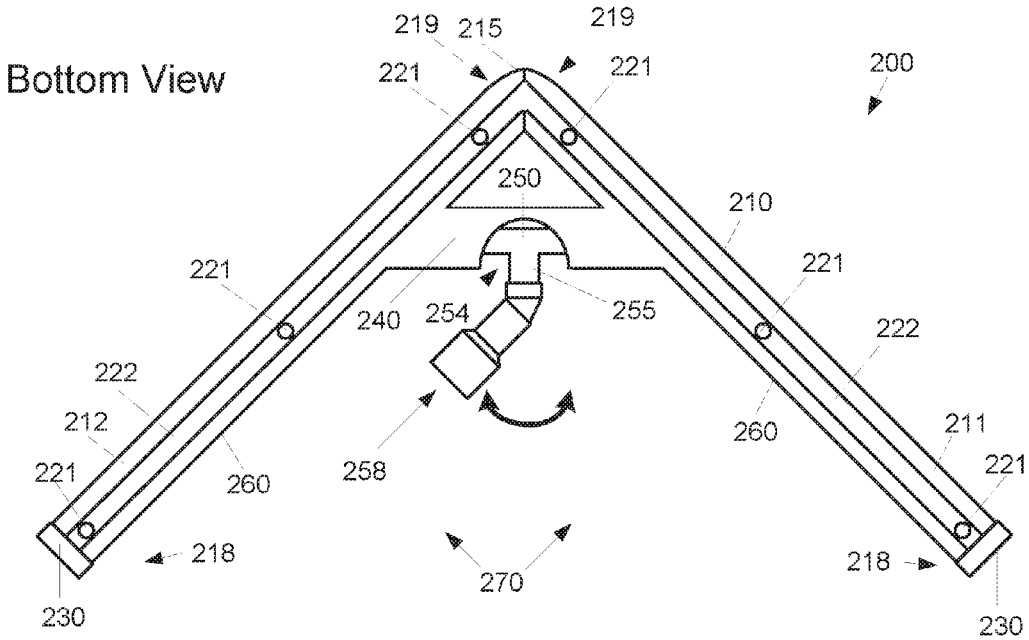
FIG. 2B is a schematic diagram of the exemplary first embodiment of a vacuum head of FIG. 2A from a bottom view.

FIG. 2A is a schematic diagram of an exemplary first embodiment of a vacuum cleaner head 200 from a top view. FIG. 2B is a schematic diagram of the exemplary first embodiment of a vacuum cleaner head 200 from a bottom view. Under the first exemplary embodiment, the vacuum cleaner head 200 is formed as a large, light weight, flexible "A" shape including a foam tube 210 with a first leg 211 (or tubular appendage) and a second leg 212 (or tubular appendage) having proximal ends 219 meeting at an apex 215 (top) of the A and distal ends extending outward from the apex 215 having an end spacing ranging from, for example, 30 to 48 inches apart. An apex angle at the apex 215 between the first leg 211 and the second leg 212 may be, preferably 90 degrees, but may be narrower or wider, for example, between 45 degrees to up to nearly 180 degrees. It should be noted that the vacuum cleaner head 200 is preferably oriented so the apex 215 is substantially opposite the central air conduit, such that the central air conduit is disposed between the first leg 211 and the second leg 212.

A tube internal channel 220 is substantially enclosed by the foam tube 210, and is indicated by a dashed line in FIG. 2A. The tube internal channel 220 may be substantially contiguous from the distal end 218 of the first leg 211 to the second leg 212, as shown in FIG. 2A. In alternative embodiments, the tube internal channel 220 may be blocked at one or more portions of the foam tube 210, for example, at the apex 215. For example, one or more blockages in the tube internal channel 220 may be desirable to facilitate a particular air flow pattern and/or suction force level at specific portions of the foam tube 210. The tube internal channel 220 may plugged or open at the distal ends 218 of the legs 211, 212. As shown in FIGS. 2A-2B, the distal ends 218 of the legs 211, 212 are plugged by end caps 230.

A horizontal cross member 240 connects to and between the first leg 211 and the second leg 212 at a location between the apex 215 and the distal ends 218. The first leg 211, the second leg 212, and the connecting cross member 240 together form an A-shaped structure. The cross member 240 may be formed of the same material as the foam tube 210. The horizontal cross member 240 at least partially surrounds a hollow T-shaped connector 250 formed of a rigid material, for example, ABS plastic or another plastic or metal, for example, aluminum. A hollow cross-connecting portion 252 of the T-shaped connector 250 configured to serve as an air conduit between the foam tube 210 and a vacuum cleaner air pump (not shown) may be embedded within and/or inlaid into the cross member 240. A hollow stem portion 255 of the T-shaped connector 250 serving as a central airflow conduit to the vacuum cleaner air pump (not shown) may protrude outward in a direction generally opposite from the apex 215. The cross-connecting portion 252 of the T-shaped connector 250 may be configured to rotate within the foam cross member 240, so that the stem portion 255 of the T-shaped connector 250 pivots with respect to the cross member 240 around a center axis of the cross-connecting portion 252.

The cross member 240 may be positioned, for example, roughly 2-4 inches back from the apex 215 along the legs 211, 212. The positioning of the cross member 240 may impact airflow, and a longer cross member 240 may make the vacuum cleaner head 200 less maneuverable. The cross member 240 need not be a straight bar, as per the first embodiment, but may instead be a V shape opposite or parallel to the V of the legs 211, 212 in alternative embodiments. Other cross member 240 shapes are also possible, for example, a curved surface.

The tube internal channel 220 provides a path for ingress air from the tube 210 through the T-shaped connector 250 to an egress end 258 of the T-shaped connector 250, conveying collected particles to an extender portion (not shown) connecting to a vacuum cleaner air pump (not shown), for example, a vacuum hose, connected to the egress end 258 of the T-shaped connector 250. The tube internal channel 220 connects to the cross-connecting portion 252 of the T-shaped connector 250 within the first leg 211 at a first cross portal 241 (or egress port), and the tube internal channel 220 connects to the cross-connecting portion 252 of the T-shaped connector 250 within the second leg 212 at a second cross portal 242 (or egress port). As described below, the first and second cross portals 241, 242 may include structural elements to secure the cross-connecting portion 252 to the foam cross member 240 and ensure adequate airflow between the tube internal channel 220 and the T-shaped connector 250, and to provide structural support for maintaining the A-shape of the head 200. The T-shaped connector 250 is generally formed of a more rigid material than the foam tube 210.

Under alternative embodiments, the cross-connecting portion 252 of the T-shape connector 250 may not be surrounded by foam, so that the cross member 240 generally consists of the cross-connecting portion 252 of the T-shape connector 250 itself. The cross-connecting portion 252 of the T-Shaped connector 250 may extend into the legs 211, 212, providing direct airflow between the internal channel 220 and the cross-connecting portion 252.

Under the first embodiment, the tube internal channel 220 may have a circular cross section shape having a substantially consistent cross section area. Under alternative embodiments, the tube internal channel 220 may have a differently shaped cross section shape, for example, oval, rectangular, etc., and have cross section areas that change in different locations within the foam tube, for example, to facilitate different levels of airflow at different location, or to accommodate larger particles in different locations.

A cross member aperture 245 located substantially at the center of the cross-connecting portion 252 serves as an opening in the foam of the cross member 240 to allow the T-shaped connector 250 to pivot up and down without the foam cross member 240 inhibiting movement of the connector portion 257 and/or a swivel elbow 256, described below.

The swivel elbow 256 allows for maneuvering a connector portion 257 located at the egress end 258 of the T-shaped connector 250 by swiveling the swivel elbow 256 around a center axis of the stem portion 255 of the T-shaped connector 255. The stem portion 255 includes an ingress portion 254 providing air intake from the cross-connecting portion 252 of the T-shaped connector 250 to the stem portion 255. The swivel elbow 256 may be an integral part of the T-shaped connector 250 as shown in FIG. 2A, or the swivel elbow 256 may be a separate attachment to the T-shaped connector 250. The swivel elbow 256 forms an angle between the egress end 258 and the stem portion 255 of the T-shaped connector 255, for example, an angle in the range of 30 degrees to 75 degrees, preferably 45 degrees. The swivel elbow 256 preferably facilitates turning the direction of the vacuum cleaner head 200 while remaining flat against the target surface. In an alternative embodiment, the stem portion 255 may be minimized or omitted, so the swivel elbow 256 connects directly to the cross-connecting portion 252 of the T-shaped connector 250.

Features of a bottom surface of the vacuum cleaner head 200 are shown in FIG. 2B. A tube ingress surface channel 222 may be formed as a groove along the bottom surface 270 (floor) of the foam tube 210 legs 211, 212, providing an air channel and a conduit for particles to be conveyed to the tube internal channel 220, via a plurality of intake holes 221 (or ingress vents) disposed between the tube ingress surface channel 222 and the tube internal channel 220. Under the first embodiment, there are six intake holes 221 of roughly the same size and shape (circular) between the tube ingress surface channel 222 and the tube internal channel 220, three intake holes 221 in each of the first leg 211 and the second leg 212. Under alternative embodiments, there may be more or fewer intake holes 221, and the positions and sizes and shapes of the intake holes 221 may be adjusted according to desired airflow and particle collection characteristics.

Figure 3A:
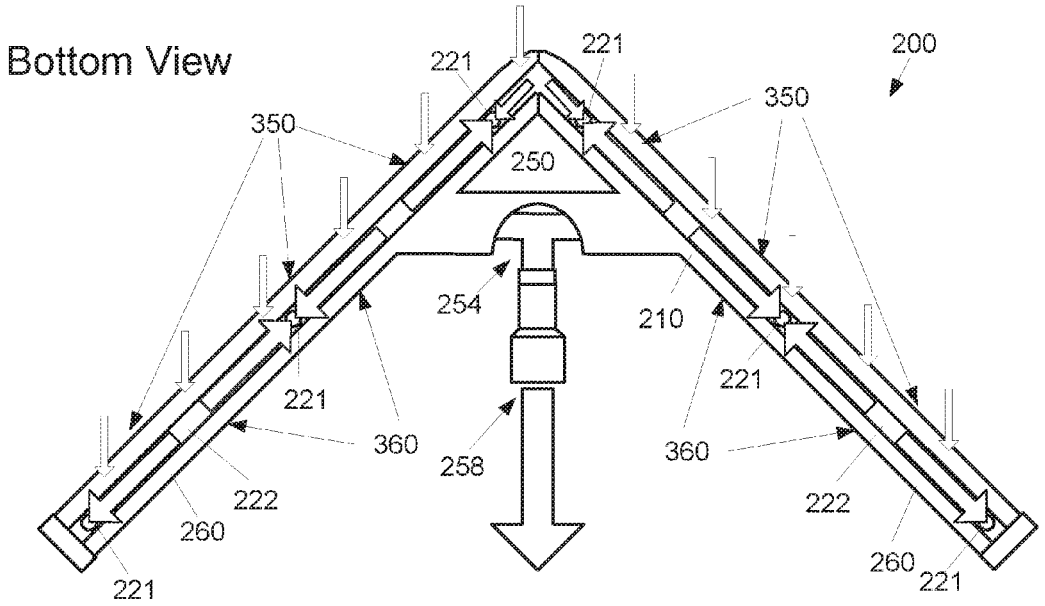
FIG. 3A is a schematic diagram of the exemplary first embodiment of a vacuum head of FIG. 2B with arrows indicating external air flow direction.
Figure 3B:
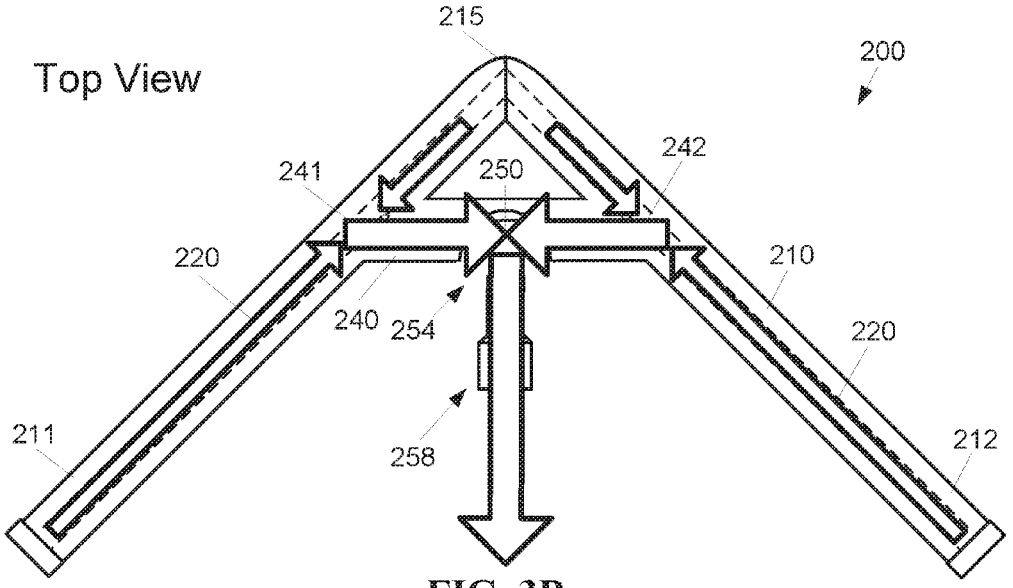
FIG. 3B is a schematic diagram of the exemplary first embodiment of a vacuum head of FIG. 2A with arrows indicating internal air flow direction.

A backstop ridge 260 may be formed along an underside trailing edge 360 (FIG. 3A) of each of the first leg 211 and the second leg 212. As shown by FIG. 3A, the backstop ridge 260, blocks intake airflow from an interior portion of the vacuum cleaner head 200 between the first leg 211 and the second leg 212, and facilitates greater intake airflow (as indicated by wide arrows) from a leading edge 350 of the vacuum cleaner head 200. Intake airflow generally occurs from beneath the leading edge 350 of the vacuum cleaner head 200, toward the intake holes 221 via the tube ingress surface channel 222. As shown by FIG. 3B, egress airflow generally occurs from the intake holes 221 to the egress end 258 via the tube internal channel 220, the first and second cross portals 241, 242, and the interior of the hollow T-shaped connector 250.

Under the first embodiment, the underside of the vacuum cleaner head 200 includes the ridge 260 running the length of the two legs 211, 212 favoring the inside edge rising slightly higher than the foam tube 210 body. The plurality of air intake holes 221, may be disposed alongside this ridge 260 running the length of each leg 211, 212 and favoring the leading edge 350 of the foam tube 210.

Figure 4:
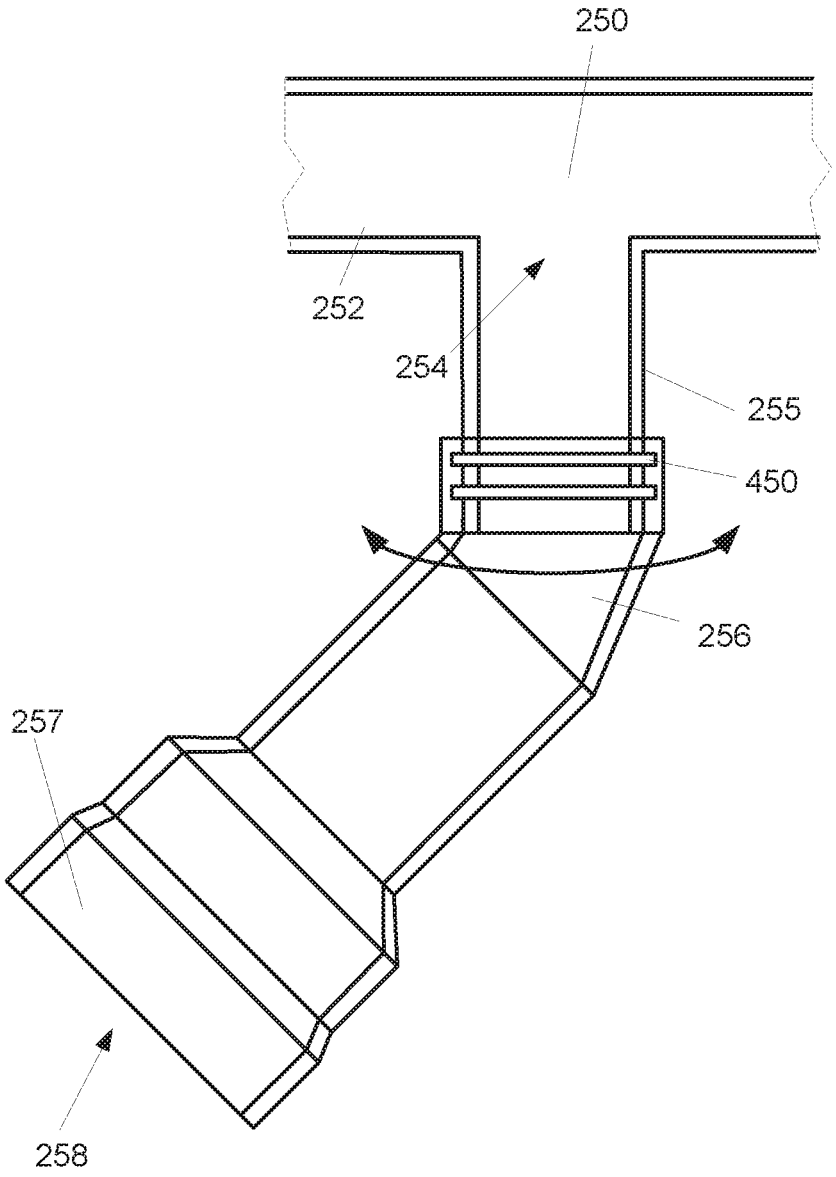
FIG. 4 is a schematic cutaway diagram of a detail of the T-shaped connector swivel elbow of the exemplary c embodiment of a vacuum head.

FIG. 4 is a schematic cutaway diagram of the T-shaped connector 250 swivel elbow 256. The stem portion 255 of the T-shaped connector 250 connects to the swivel elbow 256 via a rotating connector, for example, a ring-and-collar arrangement 450 where rings projecting from the outer surface of the stem portion 255 fit within inset collar grooves on the inner surface of the swivel elbow. Other rotating connection configurations familiar to persons having ordinary skill in the art are also possible. Such a connection allows for pivoting of the pivot elbow 256 while still facilitating airflow through the T-shaped connector 250.

Figure 5A:
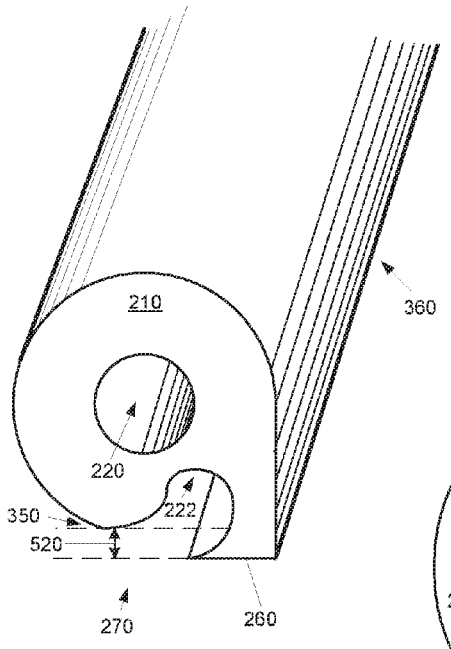
FIG. 5A is a schematic detail diagram of a top perspective view of the foam tube of the vacuum head of FIG. 2A.
Figure 5B:
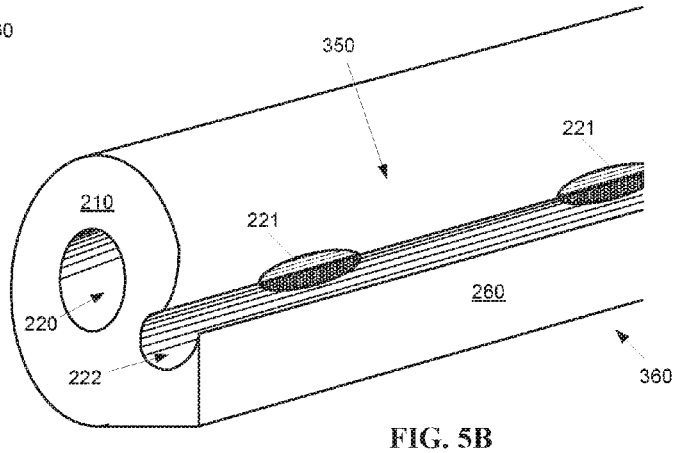
FIG. 5B is a schematic detail diagram of a bottom perspective view of the foam tube of the vacuum head of FIG. 2A.

FIG. 5A is a schematic detail diagram of a top view of the foam tube 210 of the vacuum head 200 of FIG. 2A. The backstop ridge 260 extends below the leading edge 350, providing a leading edge gap 520 where intake air and debris can enter the tube ingress surface channel 222 from the leading edge 350, while the backstop ridge 260 generally provides a contact area between the trailing edge 360 and the target surface. As shown from a bottom view by FIG. 5B, the intake holes 221 in the foam tube 210 may generally be recessed within the tube ingress surface channel 222, providing an air conduit between the tube ingress surface channel 222 and the tube internal channel 220.

Figure 6A:
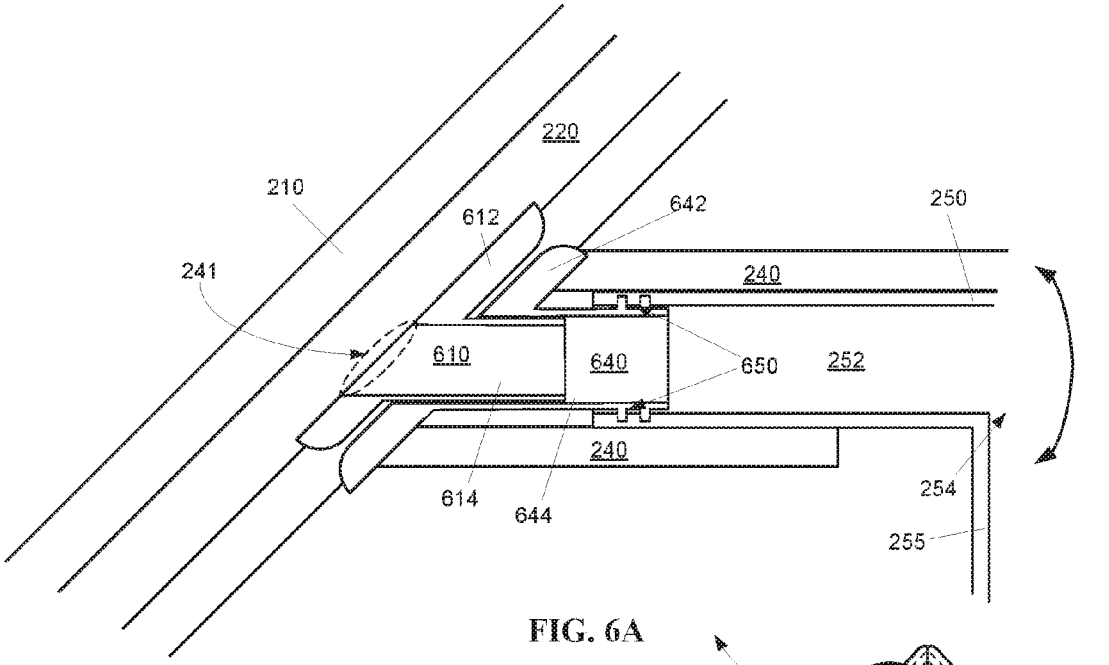
FIG. 6A is a schematic detail diagram of a top perspective view of a cross portal of the vacuum head of FIG. 2A.

As mentioned above, the first and second cross portals 241, 242 may include structural elements to secure the cross-connecting portion to the foam cross member 240 and ensure adequate airflow between the tube internal channel 220 and the T-shaped connector 250. FIG. 6A is a schematic detail diagram of the first cross portal 241 of the vacuum head 200 under the first embodiment.

Figure 6B:
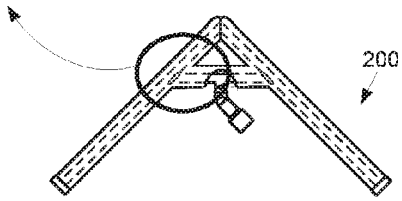
FIG. 6B is a schematic detail diagram of a top perspective view of a first flap portion and a second flap portion of FIG. 6A.
Figure 6B:
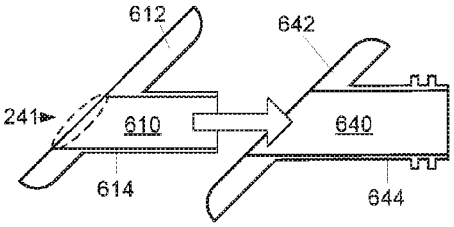

FIG. 6B is a schematic detail diagram of a top perspective view of an inner flap portion 610 and an outer flap portion 640 shown in FIG. 6A. The inner flap portion 610 is disposed inside the tube internal channel 220 of the foam tube 210. The inner flap portion 610 includes an inner flap flange portion 612 used to secure the inner flap portion 610 against the foam tube 210 at a wall of the tuber inner channel, and a hollow inner flap conduit portion 614 providing airflow between the tube internal channel 220 and the T-shaped connector 250.

The outer flap portion 640 includes an outer flap flange portion 642 used to secure the outer flap portion 640 against an outer surface of the foam tube 210, and a hollow outer flap conduit portion 644. The outer flap conduit portion 644 may be configured to receive the inner flap conduit portion 614, for example, in a telescoping arrangement, so that the foam tube 210 may be compressed and secured between the inner flap flange portion 612 and the outer flap flange portion 642. The outer flap conduit portion 644 may be fastened to the inner flap conduit portion 614, for example, via locking fastener (not shown), or another fastener familiar to persons having ordinary skill in the art.

The cross-connecting portion 252 of the T-shaped connector 250 may be configured to receive the outer flap conduit portion 644, for example, in a telescoping arrangement. Preferably, the cross-connecting portion 252 of the T-shaped connector 250 may be rotabably attached to the outer flap conduit portion 644, so that the T-shaped connector 250 may pivot within the 240 cross member. The cross-connecting portion 252 may be fastened to the outer flap conduit portion 644, for example, via a ring and collar fastener 650, or another fastener familiar to persons having ordinary skill in the art.

The inner flap portion 610 and an outer flap portion 640 may be formed, for example, of a rubberized plastic, such as thermoplastic elastomer. Both the internal and external flaps may be oval in profile shape and curved to replicate and hug the shape of the foam tube 210 that is sandwiched between the 2 flap portions 610, 640. The size of the flaps may be, for example, 2 in wide by 3 in long.

In alternative embodiments, the outer flap 630 and outer flap flange portion 642 may be omitted, so that the inner flap 610 and the inner flap flange portion 612 extend directly from the cross-connecting portion 252 into the tube internal channel 220. For example, the inner flap flange portion 612 is implemented as a trumpet flair, for example, a 90 degree 2 inch diameter flare at the end of a diameter on a one inch diameter cross-connecting portion 252.

The dimensions (length, width) of the legs 211, 212 may be in the range of 10 inches to 30 inches or more, preferably between 18 inches and 24 inches. The legs 211, 212 may be formed of a single length of tubing that is bent at the apex 215, or each legs 211, 212 may be formed of individual lengths of tubing that are joined at the apex 215. The distance between outer ends of the legs 211, 212 may be for example, on the order of 30 inches, depending upon the length of the legs 211, 212 and the size of the angle between the legs 211, 212.

The legs 211, 212 and the cross connecting portion 252 may have outer diameters in the range of 0.5 inches to 2.5 inches, preferably on the order of 1.75 inches. The legs 211, 212 and the cross connecting portion 252 need not have the same diameter.

The foam tube 210 may be formed of, for example polyethylene foam, or another suitable lightweight material. For example, the material is preferably flexible enough to bend around obstacles without undue force, as shown by FIGS. 7B and 7C, and to be bent or folded for storage and/or transport, as shown by FIG. 7C.

The foam cross member 240 and/or the T-shaped connector 250 provide structural support to the head 200, so that a forward portion 710 (shown surrounded by a dashed line) maintains a substantially constant shape, for example, a triangular shape. Free end portions 720 of the foam tube 210 extend beyond the forward portion 710. While the foam tube 210 is flexible throughout, the foam tube 210 may tend to bend most sharply at a bend area 730 where the cross member 240 and/or the T-shaped connector 250 are joined with the foam tube 210. The internal channel 220 may be reinforced at the bend area 730, for example, with stints, such as rings or short tubes formed of rubber or plastic in or near the internal channel 220, to maintain airflow through the internal channel 220 at the bend area when the foam tube 210 is bent or stressed. In general, the forward portion 710 maintains its shape, while the free end portions 720 are able to flex and bend, for example, around obstacles, or even due to resistance from the target surface.

Figure 7A:
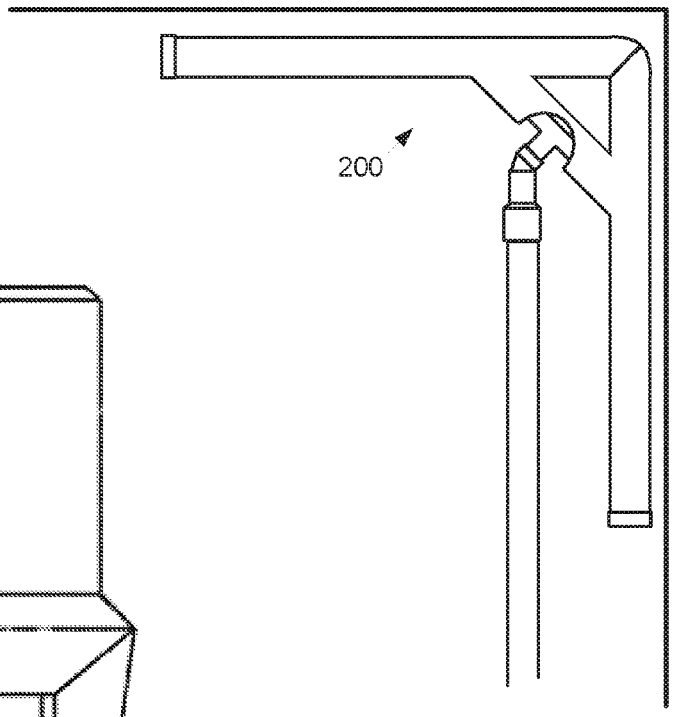
FIG. 7A is a schematic diagram of the vacuum head of FIG. 2A deployed against a corner.
Figure 7B:
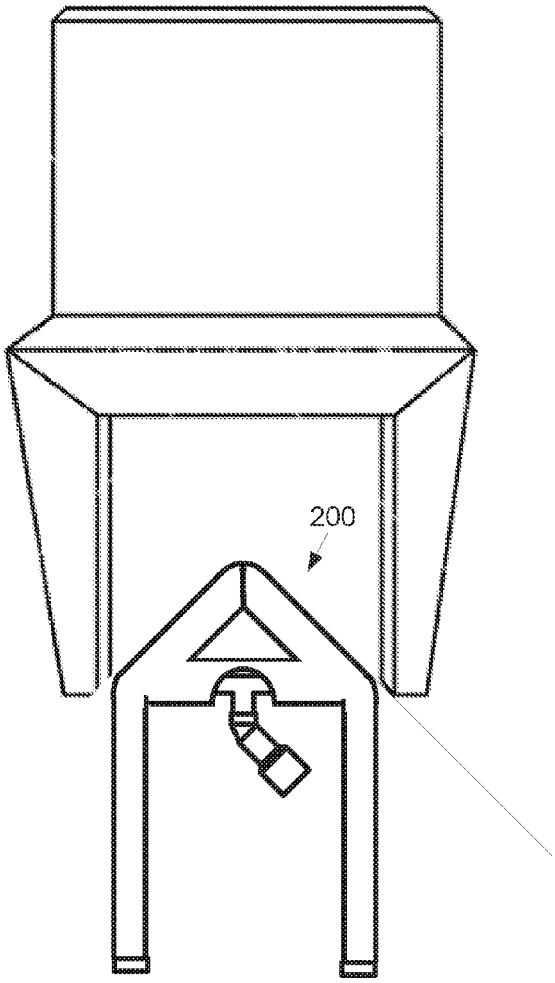
FIG. 7B is a schematic diagram of the vacuum head of FIG. 2A deployed with the legs deformed against a chair.
Figure 7C:
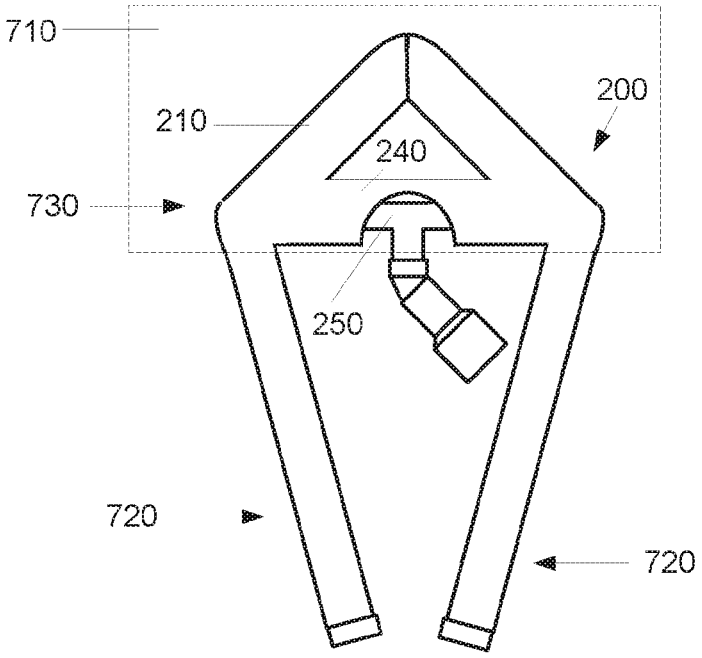
FIG. 7C is a schematic diagram of the vacuum head of FIG. 2A deployed with the legs bent or folded inward.
Figure 7D:
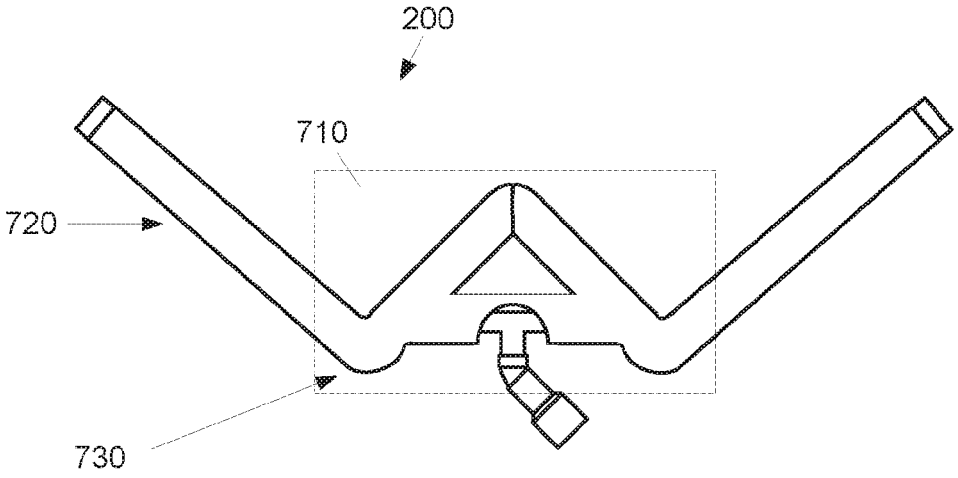
FIG. 7D is a schematic diagram of the vacuum head of FIG. 2A deployed with the legs bent or folded outward.

The material is preferably flexible enough to bend both inward and outward around obstacles without undue force, as shown by FIG. 7D. At the same time, the material preferably has sufficient memory so the free ends 720 return to their original shape after a temporary deformation. Similarly, the material is preferably sufficiently rigid to retain its shape during use, for example, while sweeping the vacuum cleaner head 200 along the floor. The foam tube 210 is preferably rigid enough such that bending the foam tube 210 at angles up to 90 degrees or more does cause the internal channel 220 to crimp or close off airflow at the bend location.

An exemplary material for the foam portions may be a 1.5 lbs./cubic ft polyethylene closed cell foam. Other densities may also be considered, for example, in the range of 1.0 to 10 lbs/cubic ft, as well as other materials, such as polyethylene open cell foam. Other resins used in foam may include several other resins such as PVC and polypropylene, among others. Portions of the vacuum cleaner head 200 that are affixed to each other in a fixed manner (not sliding or rotating) may be attached by, for example, sonic welding, or other attachment means, for example, solvent bonding, glue, and/or vibration welding.

The vacuum cleaner head 200 may be used as an attachment to a standard vacuum system hose pipe for the purpose of cleaning floors more quickly by taking advantage of its fully expanded A shape width while the foam material provides for flexing (compression) into much smaller areas, as shown by FIG. 7B, for example as small as six inches wide, and returning to the expanded size once removed from the confinement. The light weight foam requires little effort to move and provides no concern for damage while bumping items during use.

The foam material may have static electricity properties, or may be treated to have static electricity properties, that may be advantageous, for example, for attracting dust or other particles toward the vacuum cleaner head 200.

Under the first embodiment, the 90 degree angle at the apex 215 between the first leg 211 and the second leg 212 affords deep penetration of corners, as shown by FIG. 7A, without scuffing walls. The long narrow legs can make one sweep under large areas, for example a couch or chair, with little added effort or time. In alternative embodiments, the angle between the first leg 211 and the second leg 212 may be narrower or wider than 90 degrees, for example, in the range of 45 degrees to nearly 180 degrees While the above has generally described the vacuum cleaner head 200 being used for floors, the vacuum cleaner head 200 may also be used for wall cleaning applications for example following construction of new homes, avoiding damage to painted walls and ceilings.

Figure 8:
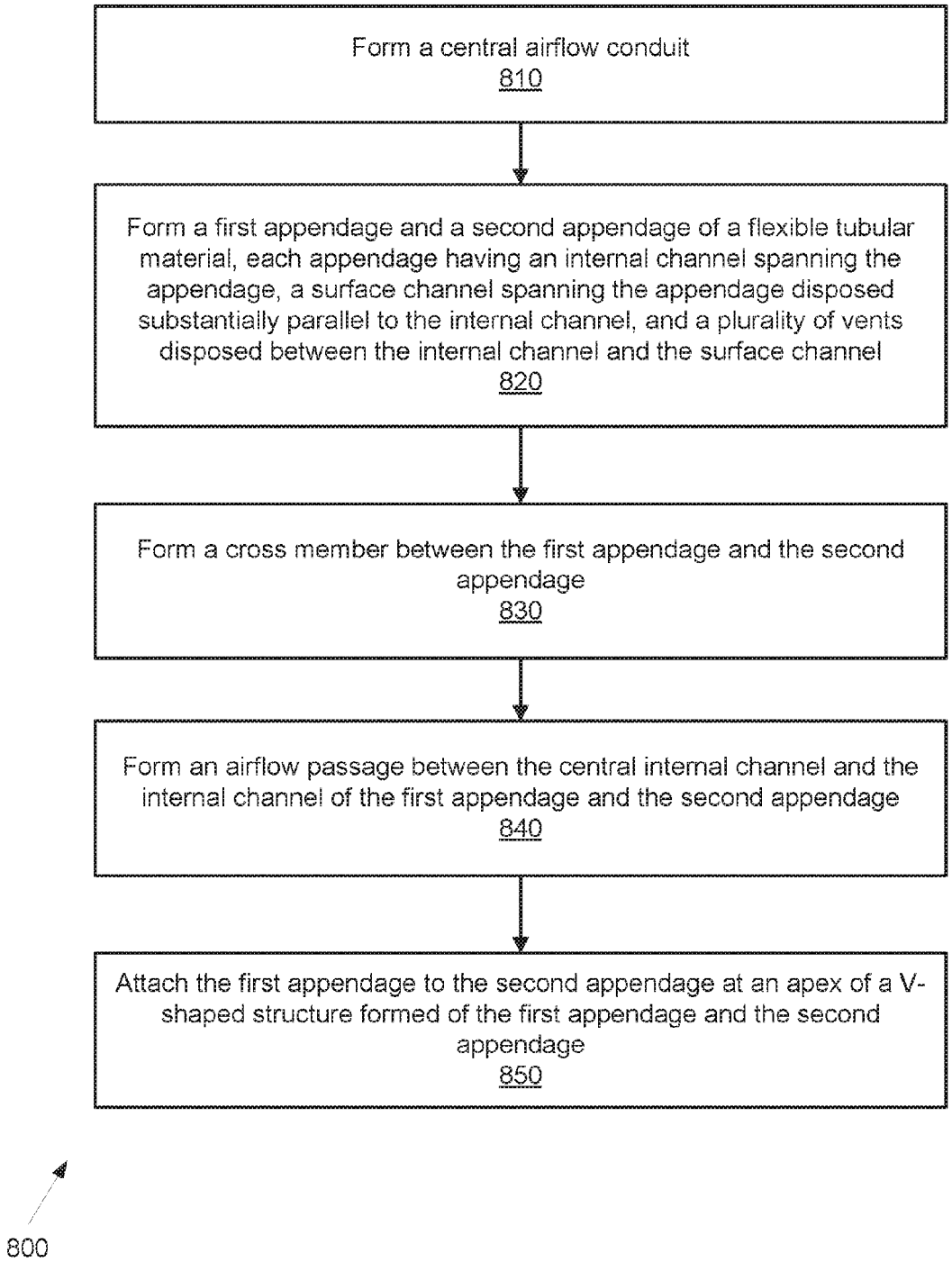
FIG. 8 is a flowchart of an exemplary method for forming a head for a vacuum cleaning device.

FIG. 8 is a flowchart of an exemplary method for forming a head for a vacuum cleaning device. It should be noted that any process descriptions or blocks in flowcharts should be understood as representing modules, segments, portions of code, or steps that include one or more instructions for implementing specific logical functions in the process, and alternative implementations are included within the scope of the present invention in which functions may be executed out of order from that shown or discussed, including substantially concurrently or in reverse order, depending on the functionality involved, as would be understood by those reasonably skilled in the art of the present invention.

A central airflow conduit is formed, as shown by block 810. The central airflow conduit may be formed of a fairly rigid material, for example, rubberized plastic. A first appendage and a second appendage are formed of a flexible tubular material, as shown by block 820. Each appendage has an internal channel spanning the appendage, a surface channel spanning the appendage disposed substantially parallel to the internal channel, and a plurality of vents disposed between the internal channel and the surface channel. A cross member between the first appendage and the second appendage is formed, as shown by block 830. An airflow passage is formed between the central internal channel and the internal channel of the first appendage and the second appendage, as shown by block 840. The first appendage is attached to the second appendage at an apex of a V-shaped structure formed of the first appendage and the second appendage, as shown by block 850.

Unlike most floor vacuum heads that use brushes as the medium contacting the target surface, embodiments of the present invention use a solid foam strip as the contact point with the area being cleaned. While rotary carpet cleaning brushes do a good job on carpets, standard floor brush heads have limited effectiveness, particularly when it comes to pet hair. A typical rotary brush uses velocity of rotating brush bristles to dislodge pet hair from carpet fibers. However, such rotary brushes are heavy and cumbersome, and lack the size and flexibility of the disclosed embodiments.

The above embodiments are very effective when used on carpets, in particular for collecting pet hair. This is due to the fact that when the head is moved over the carpet in a circular motion, the foam contact strip has a tact or gripping characteristic that, combined with the mild downward pressure, tends to lift pet hair out of the carpet fibers. While above embodiments may not outperform rotary carpet cleaning heads, they may outperform the standard brush floor heads on carpets. For a quick once-over of the floors and carpets, above embodiments provide a viable multi-purpose option.

Figure 9:
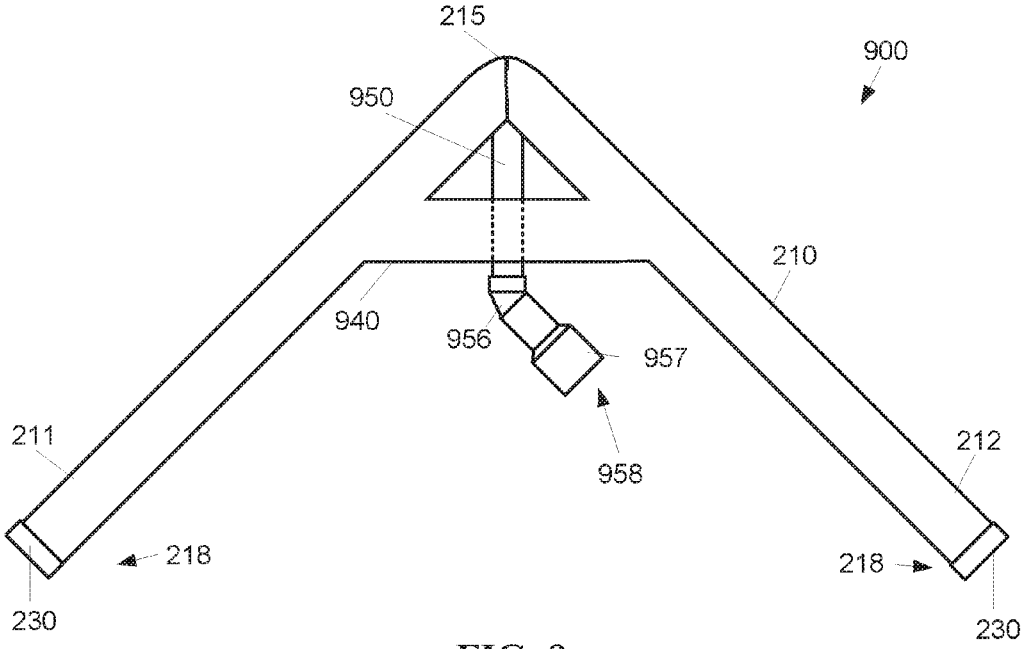
FIG. 9 is a schematic diagram of an exemplary second embodiment of a vacuum head.

It will be apparent to those skilled in the art that various modifications and variations can be made to the structure of the present invention without departing from the scope or spirit of the invention. FIG. 9 shows an exemplary second embodiment of a vacuum cleaner head 900. Reference numerals shown in FIG. 9 that are the same as the reference numerals used for the first embodiment indicate the elements are substantially similar to the first embodiment. Under the second embodiment, a cross member 940 may not include an air channel in the cross member 240 (FIG. 2) of the first embodiment, instead serving a primarily structural function. A central air conduit is formed a tubular connector 950 having an ingress portion 954 connecting the internal channel 220 (not shown) to a swivel elbow 956 that allows for maneuvering a connector portion 957 located at the egress end 958 of the tubular connector 950 by swiveling the swivel elbow 956 around a center axis of the tubular connector 950. The tubular connector 950 may pass through the cross member 940, as shown, or the tubular connector 950 may instead pass over the cross member 940.

Figure 10:
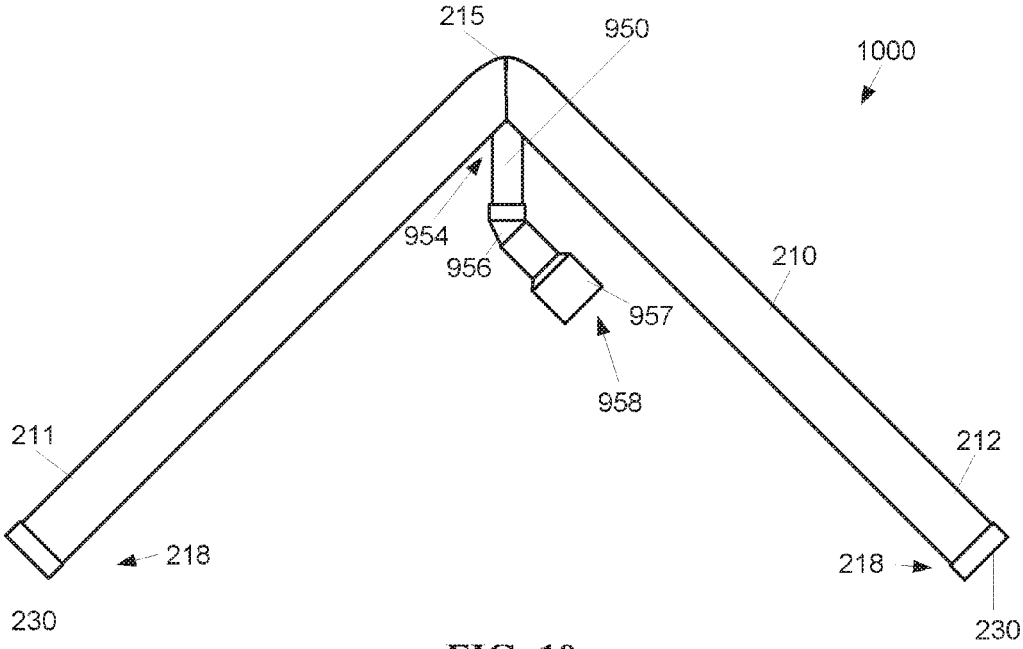
FIG. 10 is a schematic diagram of an exemplary third embodiment of a vacuum head.

FIG. 10 shows an exemplary third embodiment of a vacuum cleaner head 1000. Reference numerals shown in FIG. 10 that are the same as the reference numerals used for the second embodiment indicate the elements are substantially similar to the first embodiment. Under the third embodiment, the cross member 940 (FIG. 9) may be omitted. A central air conduit is formed a tubular connector 950 connecting the internal channel 220 (not shown) to a swivel elbow 956 that allows for maneuvering a connector portion 957 located at the egress end 958 of the tubular connector 950 by swiveling the swivel elbow 956 around a center axis of the tubular connector 950.

Other modifications and variations are possible. For example, while generally referred to as an "A-shaped structure", the cross member 240 may connect to the end portions 218 of the legs 211, 212, so the structure of the vacuum cleaner head 200 more closely resembles a triangle shape than an A-shape. Similarly, different shapes of the cross member 240 may be employed, such that the shape of the vacuum cleaner head 200 more closely resembles a diamond shape than an A-shape.

While the above embodiments have generally been described for use with a typical household vacuum cleaner, persons having ordinary skill in the art will recognize the embodiments may be used with other types of airflow systems, such as a central vacuum cleaning system, a shop vacuum, canister vacuum cleaner, and other types of fixed and portable vacuum systems. Further, the embodiments may be adapted to fluid vacuum applications, for example, a head for a pool vacuum or other water or fluid vacuum systems.

In view of the foregoing, it is intended that the present invention cover modifications and variations of this invention provided they fall within the scope of the following claims and their equivalents.

What is claimed is:

1. A head (200) for a vacuum cleaning device comprising:

a central airflow conduit (255) comprising an ingress end (254) and an egress end (258);

a first flexible tubular appendage (211) and a second flexible tubular appendage (212), each flexible tubular appendage comprising:

a distal end (218), a proximal end (219), an intermediate connection area with an egress port (241, 242) disposed between the distal ends and the proximal ends, and a floor (270);

an internal channel (220) spanning between the distal and proximal ends and connecting to the egress port;

a surface channel (222) comprising a leading edge (350) and a trailing edge (360) disposed along the floor spanning the distal and proximal ends; and a plurality of ingress vents (221) disposed between the internal channel and the surface channel; and a cross member (240) structurally connecting the first flexible tubular appendage and the second flexible tubular appendage at the intermediate connection area, the cross member further comprising a cross-connecting airflow channel providing airflow from the first flexible tubular appendage egress port to the central airflow conduit ingress end and airflow from the second flexible tubular appendage egress port to the central airflow conduit ingress end, wherein the first flexible appendage and the second flexible appendage are attached at their respective proximal ends at an apex (215), the distal ends of the first flexible appendage and the second flexible appendage extending from the apex at an angle to form an A-shaped structure with the cross member such that the trailing edge is closer to an interior portion of the A-shaped structure than the leading edge, and the central airflow conduit egress end is configured to provide airflow to the vacuum cleaning device.

2. The head of claim 1, further comprising a protruding ridge portion (260) disposed on the first flexible tubular appendage and the second flexible tubular appendage along the exterior channel trailing edge.

3. The head of claim 1, wherein the cross-connecting airflow channel further comprises a cross channel member (252) configured to pivot around a central axis of the cross member.

4. The head of claim 1, wherein the first flexible tubular appendage and the second flexible tubular appendage are formed of polyethylene foam.

5. The head of claim 4, wherein the apex angle is in a range of 60 degrees to 120 degrees.

6. The head of claim 4, wherein the polyethylene foam comprises an anti-static component.

7. The head of claim 1, wherein central airflow conduit comprises a swivel elbow (256) further comprising a stem and an angled portion connected at the swivel elbow.

8. The head of claim 7, wherein the swivel elbow stem is configured to rotate at the angled portion.

9. The head of claim 1, wherein the tube internal channel and/or the surface channel is terminated at the proximal end of the first and/or second flexible tubular appendage (211) by an end cap (230).

10. A method for forming a head for a vacuum cleaning device, comprising the steps of:

forming a central airflow conduit from a rubberized plastic;

forming a first appendage and a second appendage of a flexible tubular material, each appendage comprising:

an internal channel spanning the appendage;

a surface channel spanning the appendage disposed substantially parallel to the internal channel; and a plurality of vents disposed between the internal channel and the surface channel;

forming a cross member between the first appendage and the second appendage;

forming an airflow passage between the central airflow conduit and the internal channel of the first appendage and the second appendage; and forming an apex of an A-shaped structure formed of the first appendage and the second appendage.

11. The method of claim 10, wherein the airflow passage between the central airflow conduit and the internal channel of the first appendage and the second appendage is disposed in the cross member.

12. The method of claim 10, further comprising the step of forming a protruding ridge portion disposed on the first flexible tubular appendage and the second flexible tubular appendage along the exterior channel.

13. The method of claim 10, further comprising the step of forming a swivel elbow within the central airflow conduit.

14. The method of claim 10, wherein the apex is formed by attaching the first appendage to the second appendage.

15. A head (1000) for a vacuum cleaning device comprising:

a central airflow conduit (950) comprising an ingress end (954) and an egress end (958); and a first flexible tubular appendage and a second flexible tubular appendage, each flexible tubular appendage comprising a distal end (218), a proximal end (219), a floor (270), an internal channel (220) spanning between the distal and proximal ends, an egress port configured to provide air flow to the central airflow conduit from the internal channel, a surface channel (222) comprising a leading edge (350) and a trailing edge (360) disposed along the floor spanning the distal and proximal ends, a plurality of ingress vents (221) disposed between the internal channel and the surface channel configured to provide airflow between the internal channel and the surface channel, wherein the first flexible appendage and the second flexible appendage are attached at their respective proximal ends at an apex (215), the distal ends of the first flexible appendage and the second flexible appendage extending from the apex to form a V-shaped structure such that the trailing edge is closer to an interior portion of the V-shaped structure than the leading edge, the central airflow conduit ingress end is in airflow communication with the first flexible tubular appendage and/or the second flexible tubular appendage at the interior portion of the V-shaped structure, and the central airflow conduit egress end is configured to connect to the vacuum cleaning device.

16. The head of claim 15, further comprising a cross member (940) structurally connecting the first flexible tubular appendage and the second flexible tubular appendage at an intermediate connection area disposed between the distal ends and the proximal ends.

* * * * *